US005926891A

United States Patent [19]

Velasquez et al.

[11] Patent Number: 5,926,891

[45] Date of Patent: Jul. 27, 1999

[54] MULTIPLE UTILITY POOL ACCESSORY

[76] Inventors: Robert L Velasquez; Adam Velasquez, both of 20098 Tollhouse, Fresno, Calif. 93611

[21] Appl. No.: 09/021,264

[22] Filed: Feb. 10, 1998

[51] Int. Cl.[6] ..... E04H 4/16

[52] U.S. Cl. ..... 15/1.7; 15/257.1; 15/105; 210/169; 210/238; 294/24; 451/524

[58] Field of Search ..... 15/1.7, 105, 257.01, 15/257.1, 146; 81/176.15, 176.3; 7/138, 151, 167, 170; 210/238, 470, 471, 169; 294/24, 53.5; 248/316.1, 316.4; 403/3, 4; 451/523–525, 552, 557

[56] References Cited

U.S. PATENT DOCUMENTS

| | | | |
|---|---|---|---|
| 2,942,830 | 6/1960 | Senay | 248/316.4 |
| 3,498,009 | 3/1970 | Taafe | 451/525 |
| 4,003,100 | 1/1977 | Whitaker | 15/1.7 |
| 4,247,216 | 1/1981 | Pansini | 15/1.7 |
| 5,473,786 | 12/1995 | Resh | 15/1.7 |

*Primary Examiner*—Terrence R. Till
*Attorney, Agent, or Firm*—Goldstein & Canino

[57] ABSTRACT

A multiple utility pool accessory, for attaching to a standard pool service pole and performing multiple pool maintenance duties. A handle, having a handle open end attaches onto the pool service pole. A main assembly cross bar attaches to the handle opposite the handle open end, and extends transverse to the handle. A pair of angle brackets each comprise a projecting leg having an outer surface, and a slotted leg. The slotted leg of each angle bracket is pivotably secured to the main assembly cross bar, so that the angle brackets are selectively pivotable between a narrow position wherein the outer surfaces face each other, and a wide position wherein the outer surfaces face away from each other. Variation between the wide position and narrow position allows a variety of attachments to be secured between the angle brackets, including a grinding wheel for scraping debris, chlorine tablet for concentrated application of chlorine, and a collector basket for removing loose debris. The projecting legs are also provided with extension tabs, which facilitate easy removal of a drain cover with the brackets in the wide position.

11 Claims, 4 Drawing Sheets

MULTIPLE UTILITY POOL ACCESSORY

BACKGROUND OF THE INVENTION

The invention relates to a multiple utility pool accessory. More particularly, the invention relates to an accessory which attaches onto a standard pool service pole, and has structure which is adaptable for cleaning and scraping the pool sides, removing debris, concentrated application of chlorine, and even prying open a drain cover.

Perhaps the only downside to pool ownership is the required pool maintenance that is a necessary part of being a pool owner. Indeed, a pool owner can easily spend more time maintaining a pool than actually enjoying the pool. In addition, pool owners tend to be more affluent busy professionals and business owners who typically have less time for pool maintenance.

Most pool owners own a service pole. Typically the service pool is used with a skimmer attachment to skim debris off the pool surface, or to guide a vacuum head around the pool bottom. The service pole has a standard connector which employs a V-clip to attach extension poles or accessories.

A variety of pool accessories are available for different purposes. Generally, a separate accessory is necessary for performing a certain task. Thus, one must collect a variety of accessories to perform even the most basic pool maintenance duties.

While these units may be suitable for the particular purpose employed, or for general use, they would not be as suitable for the purposes of the present invention as disclosed hereafter.

SUMMARY OF THE INVENTION

It is an object of the invention to produce a pool accessory which is capable of performing a variety of pool maintenance functions.

It is another object of the invention to provide a pool accessory which attaches onto a standard service pole. The pool accessory therefore is easily attachable and detachable therefrom before and after each use.

It is yet another object of the invention that its structure is reconfigurable to perform cleaning, scraping, debris removal, intensive chlorine application, and drain cover removal. Angle brackets are provided which selectively enter a wide position or narrow position, and can adjust the relative width between said angle brackets in each of these positions, for accommodating a wide variety of attachments.

The invention is a multiple utility pool accessory, for attaching to a standard pool service pole and performing multiple pool maintenance duties. A handle, having a handle open end attaches onto the pool service pole. A main assembly cross bar attaches to the handle opposite the handle open end, and extends transverse to the handle. A pair of angle brackets each comprise a projecting leg having an outer surface, and a slotted leg. The slotted leg of each angle bracket is pivotably secured to the main assembly cross bar, so that the angle brackets are selectively pivotable between a narrow position wherein the outer surfaces face each other, and a wide position wherein the outer surfaces face away from each other. Variation between the wide position and narrow position allows a variety of attachments to be secured between the angle brackets, including a grinding wheel for scraping debris, chlorine tablet for concentrated application of chlorine, and a collector basket for removing loose debris. The projecting legs are also provided with extension tabs, which facilitate easy removal of a drain cover with the brackets in the wide position.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
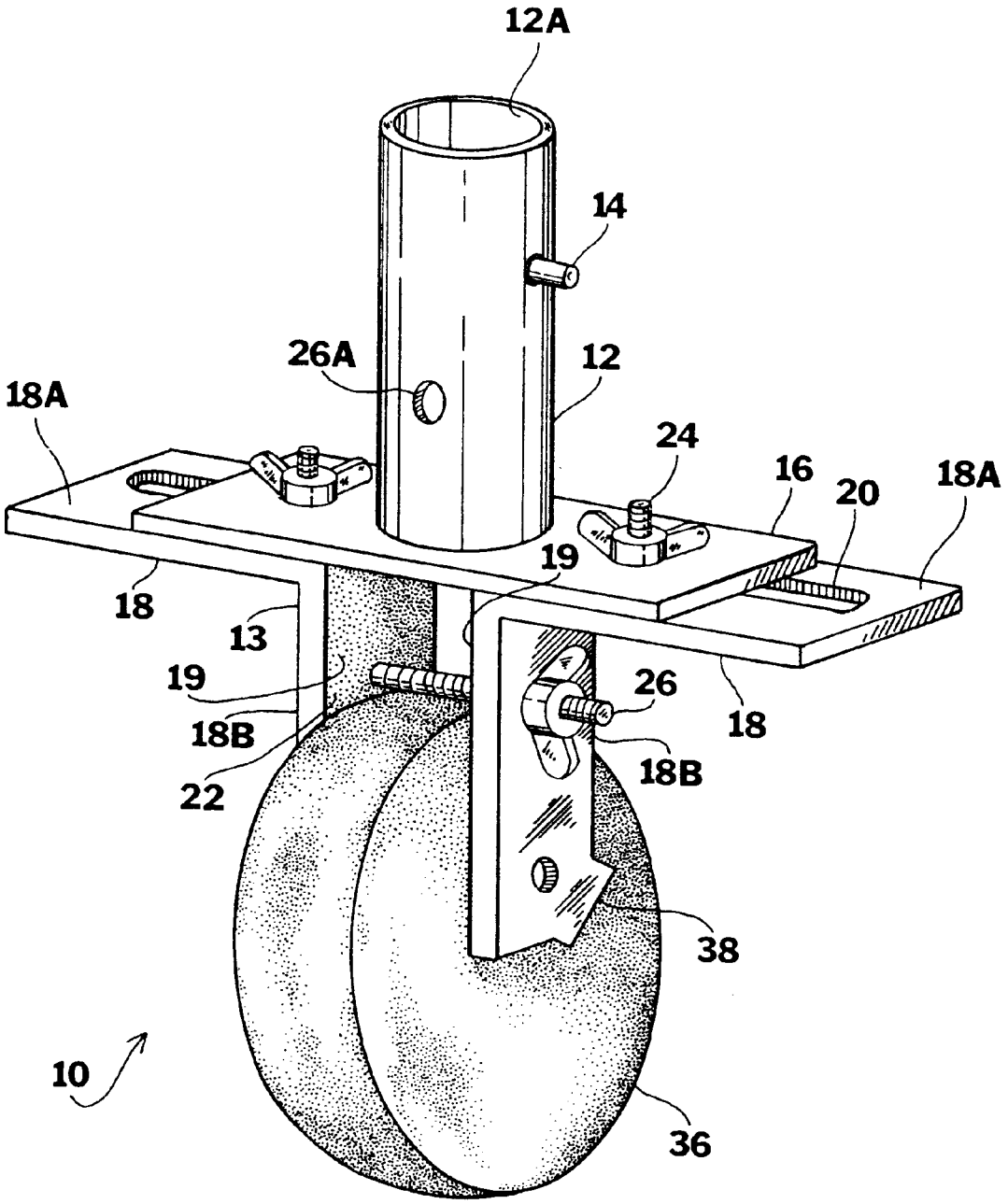
FIG. 1 is a diagrammatic perspective view, illustrating the invention, configured to hold a grinding wheel or chlorine tablet.

FIG. 1 illustrates a pool accessory 10 comprising a handle 12 and a main assembly 13 attached to the handle 12. The handle is a tube having a handle open end 12A, which is designed to attach to standard pool service poles. Thus, a v-lock mechanism 14 is provided near the handle open end 12A for selectively securing and releasing the service pole in the open end.

The main assembly 13 is attached to the handle 12 opposite the handle open end 12A. The main assembly 13 comprises a main assembly cross bar 16, which extends transverse to the handle 12. The main assembly 13 further comprises a pair of angle brackets 18 which are selectively mountable to the main assembly cross bar 16 with main assembly bolts 24.

Each of the angle brackets 18 comprises a slotted leg 18A and a projecting leg 18B. The slotted leg 18A of each angle bracket 18 forms a right angle with the projecting leg 18B of the same angle bracket 18. Each angle bracket has a longitudinal slot 20 extending along the slotted leg 18A. The slotted leg 18A is mounted against the main assembly cross bar 16, parallel thereto, with the main assembly bolts 24. The main assembly bolts 24 extend through the main assembly cross bar 16 and through the longitudinal slots 20 of the angle brackets 18. When the main assembly bolts 24 are loosened, the angle brackets 18 can move toward and away from each other. The relative position of the angle brackets 18 is fixed by tightening the main assembly bolts 24.

Each of the angle brackets 18 has an outer surface 19 on the projecting leg 18B. The outer surface 19 does not face the projecting leg 18B, but is separated from the slotted leg 18A by a 270 degree angle. The outer surface 19 of each angle bracket 18 has a abrasive non-skid surface 22.

The angle brackets 18 are each pivotable about the main assembly bolts 24 between two positions, a wide position and a narrow position. Altering the angle brackets 18 between the wide and narrow position involves pivoting the angle bracket 180 degrees around the main assembly bolts 24.

When in the narrow position, the outer surfaces 19 of the brackets 18 face each other, and the projecting legs 18B form a narrow opening therebetween. FIG. 1 illustrates the brackets 18 in the narrow position.

Figure 2:
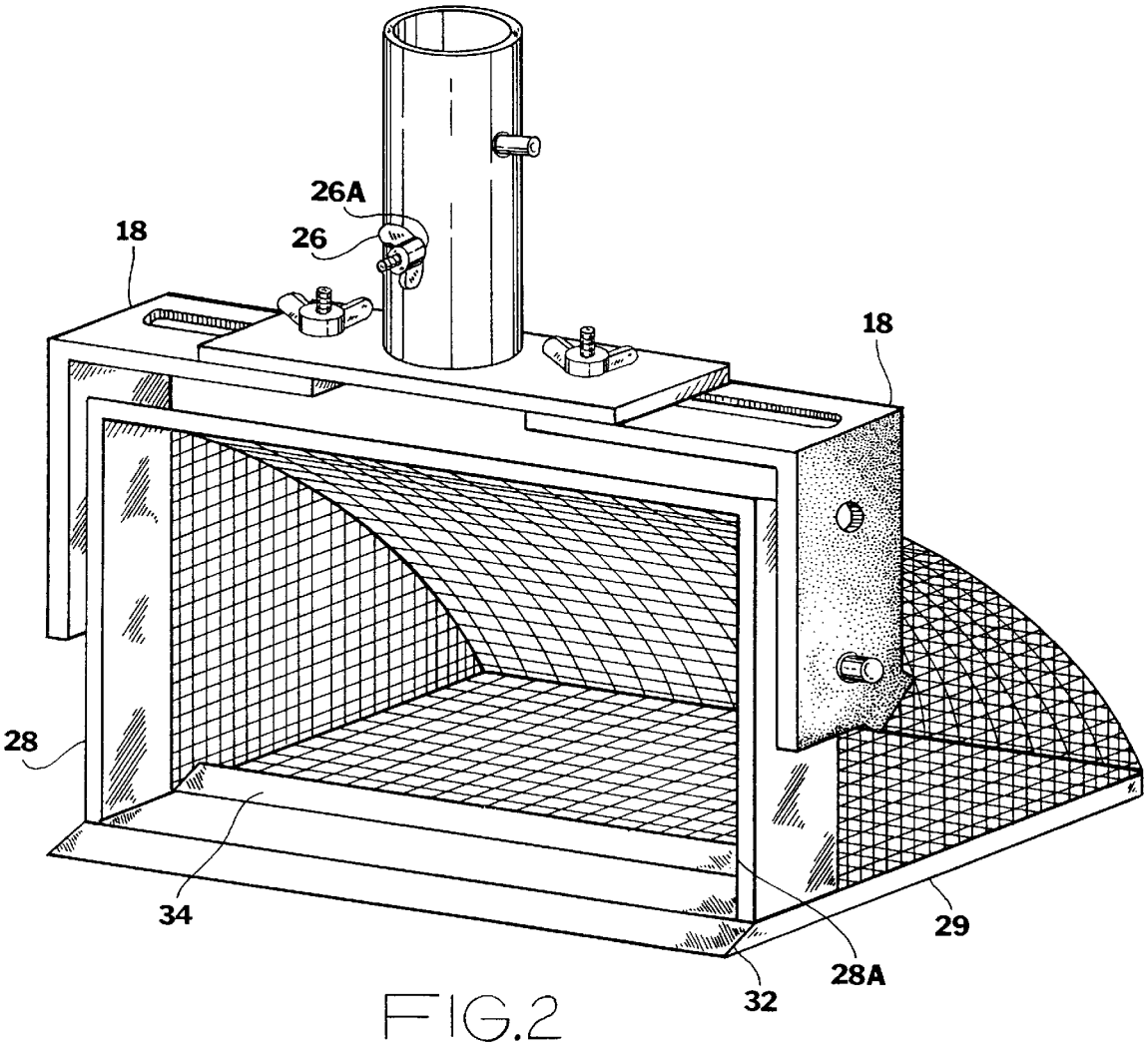
FIG. 2 is a diagrammatic perspective view, illustrating the invention configured with a collector basket.

When in the wide position, the outer surfaces 19 of the brackets 18 face away from each other, and the projecting legs 18B form a wide opening. FIG. 2 illustrates the brackets 18 in the wide position. The terms "narrow" and "wide" as used herein, are not intended to specify any particular dimension, but are comparative terms that are used to compare different positions for the elements of the invention as described.

Referring back to FIG. 1, the brackets 18 are in the narrow position, wherein a grinding wheel 36 is fastened between the outer surfaces 19 of the projecting legs 18B. A chorine tablet can also be fastened in the same manner as the grinding wheel 36. Note that the outer surfaces 19 are actually facing inward. The abrasive non-skid surfaces 22 of the brackets 18 engage the grinding wheel 36 and help hold said grinding wheel 36 in place. A compression bolt and nut 26 extend through both projecting legs 18B to tighten the angle brackets 18 against the grinding wheel. Preferably, the grinding wheel is mounted up against the compression bolt and nut 26, as illustrated. A compression bolt and nut storage hole 26A is provided in the handle 12 for storing the compression bolt and nut 26 when it is not being used to hold the grinding wheel or chlorine tablet. When the grinding wheel 36 is mounted between the brackets 18, a user can scrape staining matter from the pool sides by directing the grinding wheel 36 against the pool sides with the service pole. Similarly, when the chlorine tablet is fastened between the brackets 18 it allows direct application of chlorine to dark algae and other places in the pool which would benefit from a concentrated application of chlorine.

FIG. 2 illustrates the pool accessory 10, wherein the brackets 18 have been pivoted 180 degrees into the wide position. A collector basket 28 is pivotally attached between the brackets 18 with a pair of basket pivot pins 30. The collector basket 28 has a basket open end 28A and a bottom surface 29. The bottom surface 29 extends parallel to the main assembly cross bar 16. The collector basket 28 has a beveled scoop 32 located on the bottom surface 29 at the basket open end 28A. The beveled scoop 32 aids the collector basket 28 in picking up small debris, by providing a knife like edge that can be pulled across the pool bottom. The collector basket 28 further has a back-up retainer 34 which extends from the bottom surface 29 near the beveled scoop 32 just inside the basket open end 28A, and extends inward and upward. The back-up retainer 34 helps maintain debris in the collector basket 28 once it has entered said basket 28. Also illustrated in FIG. 2, the compression bolt and nut 26 are being stored in the compression bolt and nut storage hole 26A.

Figure 3:
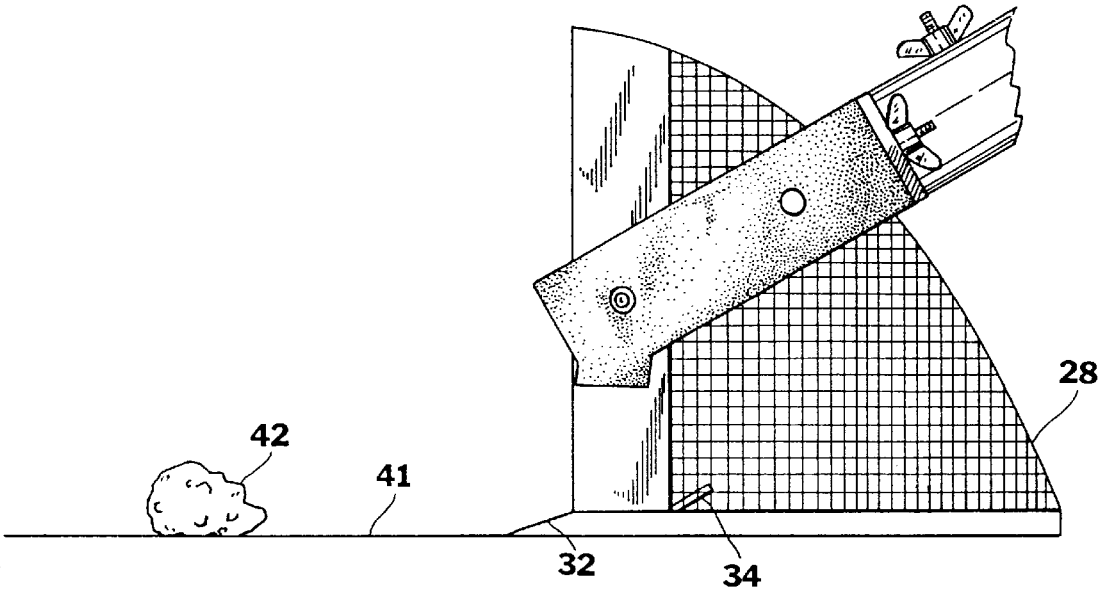
FIG. 3 is a side elevational view, illustrating the invention ready to capture a rock in the collector basket.

FIG. 3 illustrates the beveled scoop 32 in action, being used to pick up a rock 42 on the pool bottom 41. The rock 42 is positioned in front of the beveled scoop 32. The scoop 32 is pushed against the pool surface, and is urged up into the collector basket 28 by the beveled scoop, which functions like an inclined plane—converting the forward motion of the scoop 32 into a lifting force acting upon the rock 42. Once the rock has entered the basket 28, and cleared the back-up retainer 34, it is retained in the basket by said back-up retainer 34.

Figure 4:
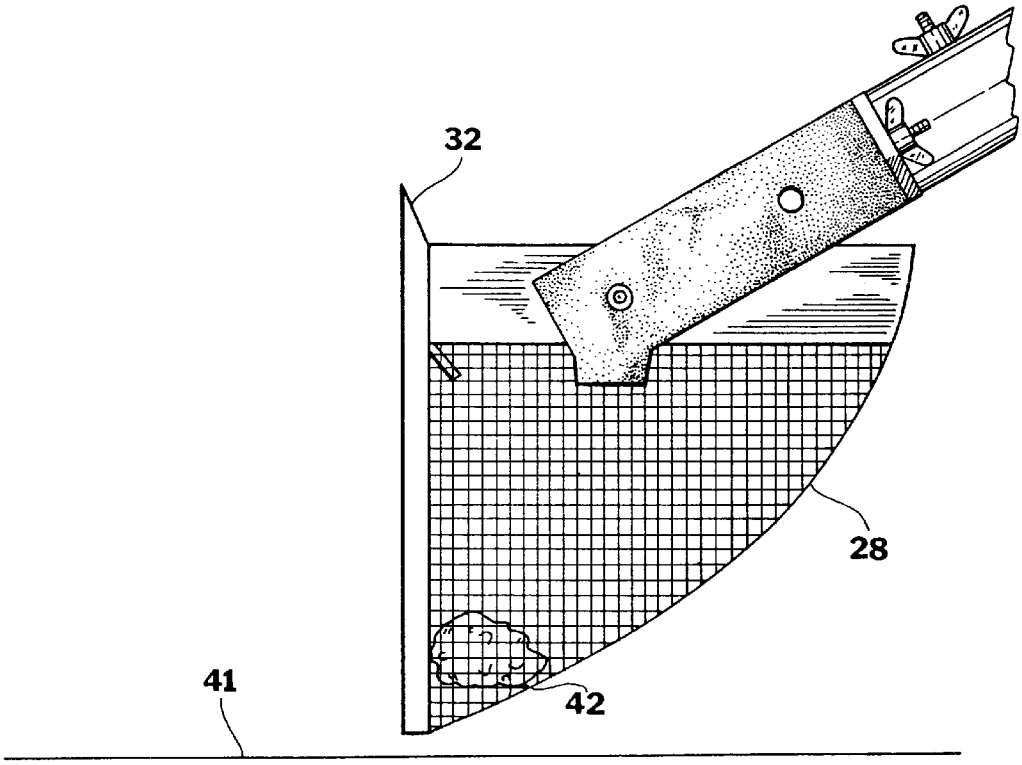
FIG. 4 is a side elevational view, wherein the rock has been captured by the collector, and has pivoted under the weight of the rock into a position wherein it will retain the rock until it is manually removed therefrom.

FIG. 4 illustrates the collector basket 28, after the rock 42 has been drawn into the collector basket 28 and the scoop 32 has been lifted from the pool bottom 41. The basket 28 has pivoted under the weight of the rock 42, further helping retain the rock 42 in the basket 28 until it is manually removed therefrom, once the basket has been brought outside of the pool.

Once again referring to FIG. 1, it can be seen that the angle brackets 18 each have an extension tab 38, extending from its projecting leg 18B. The extension tab 38 extends at approximately a forty-five degree angle from the projecting leg 18B, opposite from the slotted leg 18A.

Figure 5:
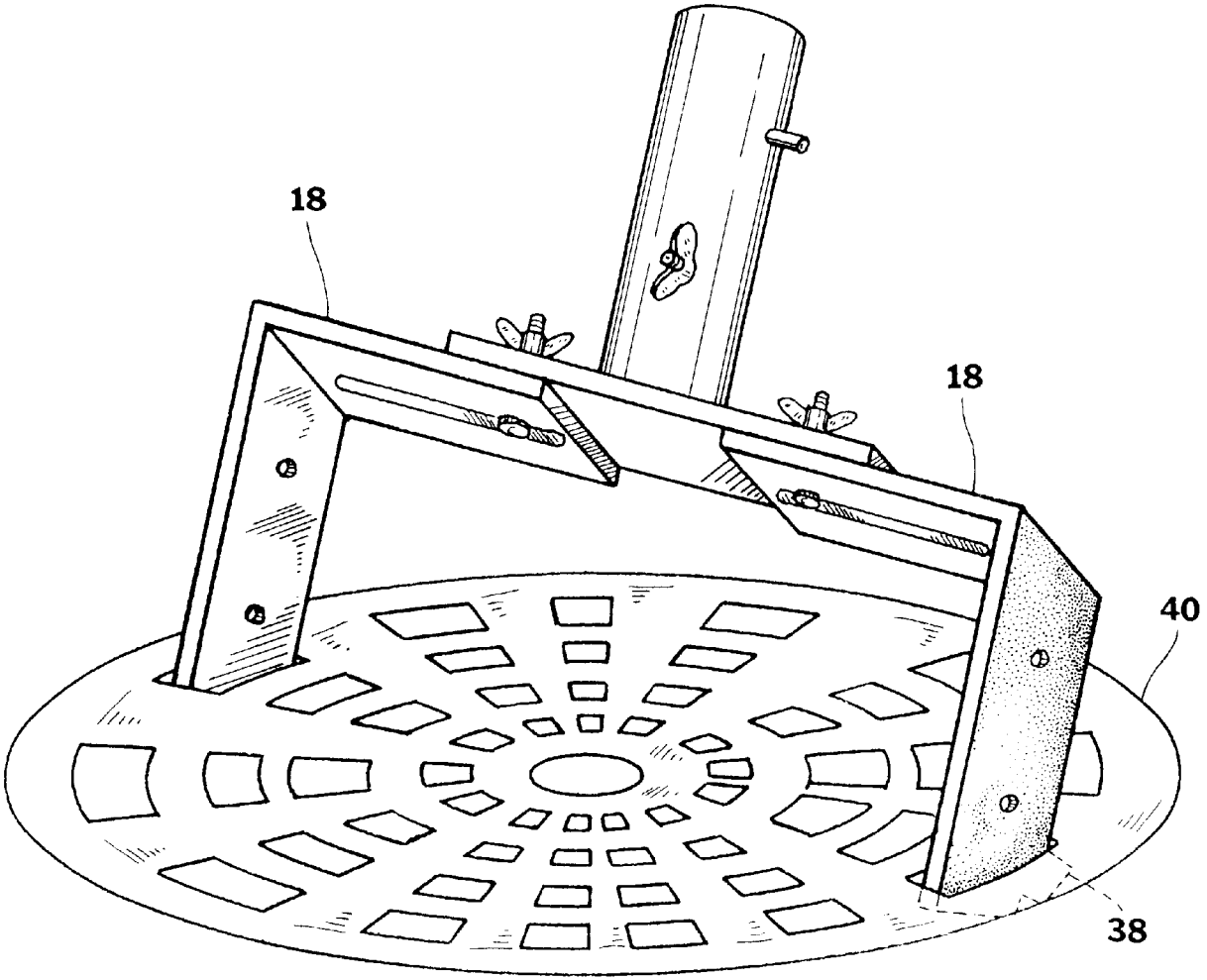
FIG. 5 is a diagrammatic perspective view, illustrating the invention, configured to open a drain cover.

Now with references to FIG. 5, the angle brackets 18 are in the wide position, The extension tabs 38 have been inserted through and beneath a drain cover 40, and are being used to pry the drain cover upward.

Many other modes of operation are possible with the angle brackets 18 configured in either the wide position or narrow position. The examples given herein, of the grinding wheel, chlorine tablet, collector basket, and prying action are illustrative only of the many possible uses for the multiple utility pool accessory.

In conclusion, herein is presented a multiple utility pool accessory which attaches onto a standard service pole, has a pair of angle brackets which are selectively pivotable between a wide position and a narrow position for accommodating a wide variety of attachments and allowing a wide variety of pool maintenance tasks to be performed.

What is claimed is:

1. A multiple utility pool accessory, for attaching onto a pool service pole, comprising:

a handle, having a handle open end for attaching to the pole;

a main assembly cross bar attached to the handle opposite the handle open end extending transverse to the handle; and a pair of angle brackets, each of said brackets having a slotted leg and a projecting leg which are separated by substantially a ninety degree angle, the slotted leg is pivotably secured to the main assembly cross bar, said cross bar extending parallel thereto, the projecting legs each have an outer surface which is substantially two hundred seventy degrees from the slotted leg, the brackets are selectively pivotable on the cross bar one hundred eighty degrees between a narrow position wherein the outer surfaces of the brackets face each other, and a wide position wherein the outer surfaces of the brackets face away from each other.

2. The multiple utility pool accessory as recited in claim 1, wherein the slotted legs each have a longitudinal slot, and further comprising main assembly bolts that are capable of being loosened or tightened, wherein the main assembly cross bar is rigidly secured to the angle brackets with the main assembly bolts when tightened, said main assembly bolts extending through the longitudinal slot for allowing the angle brackets to move toward and away from each other when loosened.

3. The multiple utility pool accessory as recited in claim 2, further comprising a compression bolt and nut which extends between the projecting legs for compressing between the projecting legs an item selected from a grinding wheel and chlorine tablet.

4. The multiple utility pool accessory as recited in claim 3, wherein the outer surfaces further comprising an abrasive anti-skid surface.

5. The multiple utility pool accessory as recited in claim 4, wherein the handle further comprises a compression bolt and nut storage hole for storing the compression bolt and nut when it is not being used to hold an item between the projecting legs.

6. The multiple utility pool accessory as recited in claim 5, further comprising a collector basket, the collector basket having a basket open end and a bottom surface, the collector basket also having a beveled scoop at the bottom surface and basket open end, the collector basket selectively attachable between the angle brackets when the angle brackets are in the wide position.

7. The multiple utility pool accessory as recited in claim 6, wherein the collector basket further comprises a back-up retainer which is located on the bottom surface just inside the basket open end and extending inward and upward therefrom.

8. The multiple utility pool accessory as recited in claim 7, wherein each angle bracket further has an extension tab which extends from the projecting leg, said extension tab extending at substantially a forty five degree angle from the projecting leg.

9. The multiple utility pool accessory as recited in claim 2, further comprising a collector basket, the collector basket having a basket open end and a bottom surface, the collector basket also having a beveled scoop at the bottom surface and basket open end, the collector basket selectively attachable between the angle brackets when the angle brackets are in the wide position.

10. The multiple utility pool accessory as recited in claim 9, wherein the collector basket further comprises a back-up retainer which is located on the bottom surface just inside the basket open end and extending inward and upward therefrom.

11. The multiple utility pool accessory as recited in claim 10, wherein each angle bracket further has an extension tab which extends from the projecting leg, said extension tab extending at substantially a forty five degree angle from the projecting leg.

* * * * *